US005482021A

United States Patent [19]

Roche

[11] Patent Number: 5,482,021

[45] Date of Patent: Jan. 9, 1996

[54] AIR/FUEL HANDLING SYSTEM FOR FUEL INJECTION ENGINE

[75] Inventor: Ronald H. Roche, Cass City, Mich.

[73] Assignee: Walbro Corporation, Cass City, Mich.

[21] Appl. No.: 150,474

[22] Filed: Nov. 11, 1993

[51] Int. Cl.[6] ..... F02M 37/04

[52] U.S. Cl. ..... 123/456; 123/509

[58] Field of Search ..... 123/516, 456, 123/509, 52 M, 468, 469, 184, 53, 184, 42; 417/423.3

[56] References Cited

U.S. PATENT DOCUMENTS

| | | | |
|---|---|---|---|
| 2,801,620 | 8/1957 | Goodridge | 123/184.53 |
| 4,254,746 | 3/1981 | Chiba | 123/184.42 |
| 4,416,108 | 11/1983 | Ghandi | 123/516 |
| 4,656,987 | 4/1987 | Arpaia | 123/516 |
| 5,101,792 | 4/1992 | Koch | 123/456 |
| 5,103,793 | 4/1992 | Riese | 123/509 |
| 5,115,784 | 5/1992 | Mito et al. | 123/516 |
| 5,173,037 | 12/1992 | Martin | 417/423.3 |
| 5,205,244 | 4/1993 | Nakamura | 123/184.42 |
| 5,295,467 | 3/1994 | Hafiver | 123/456 |
| 5,309,885 | 5/1994 | Rawlings | 123/516 |
| 5,361,742 | 11/1994 | Briggs | 123/514 |
| 5,392,750 | 2/1995 | Laue | 123/509 |

FOREIGN PATENT DOCUMENTS

| | | | |
|---|---|---|---|
| 0423636 | 4/1991 | European Pat. Off. | 123/497 |
| 4295172 | 10/1992 | Japan | 123/509 |

*Primary Examiner*—Carl S. Miller

*Attorney, Agent, or Firm*—Barnes, Kisselle, Raisch, Choate, Whittemore & Hulbert

[57] ABSTRACT

An air/fuel handling system for a small fuel injected engine with a preferably extruded body having an air tuning chamber, a fuel pump chamber and a fuel rail chamber therein for supplying fuel to one or more fuel injectors. A preferably separate fuel metering and throttle body is mounted on the chamber body. Air is supplied to an intake passage of the throttle assembly to the air chamber which has ram tubes for supplying combustion air to the intake manifold of the engine. Fuel from a remote gasoline tank is supplied through a metering valve assembly to the inlet of an electric fuel pump mounted in the pump chamber which supplies high pressure fuel to the fuel rail and injectors and thus to the engine. Fuel vapor in the metering chamber is separated from liquid fuel and supplied to the air intake chamber when the engine is operating.

23 Claims, 2 Drawing Sheets

AIR/FUEL HANDLING SYSTEM FOR FUEL INJECTION ENGINE

FIELD OF THE INVENTION

This invention relates to an air/fuel handling system for a fuel injected engine and more particularly to a device for use with small engines used in the marine environment such as inboard and outboard engines and engines used for personal watercrafts, and for other vehicles such as snowmobiles, tractors and the like.

BACKGROUND OF THE INVENTION

Modern fuel injection systems for gasoline engines are primarily designed for and used in automobile or truck applications. However, due to governmental emission regulations and customer demand, fuel injection systems for engines for boats, personal water crafts, snowmobiles, lawn tractors, etc. are now desired.

Applications of fuel injection systems to such small engines have different design requirements than those of automobiles. In such applications, it is impractical to have any high pressure fuel lines between the engine and a remote fuel tank. Coast Guard regulations require that a pressurized fuel line from the gas tank to the engine cannot be more than 12 inches long.

SUMMARY OF THE INVENTION

An air/fuel handling system for a fuel injection engine is provided for small engines such as those used in the marine environment or for small vehicles. The air/fuel handling system has a body having a fuel rail to supply high pressure fuel to the engine through one or more fuel injectors, a fuel pump housed therein to supply high pressure fuel to the fuel rail, and a low pressure fuel metering chamber to supply fuel to the fuel pump. An air chamber is formed in the body to supply air to the engine and a vapor separator is provided between the fuel metering chamber and the air chamber to separate vapor from liquid fuel and mix the fuel vapor with air entering the chamber. A throttle valve controls the quantity of air entering the chamber.

Objects, features and advantages of this invention are to provide an air/fuel handling system for engines for small crafts and vehicles that supplies high pressure fuel to the fuel rail while complying with governmental regulations for marine fuel systems, that is safe, economical to manufacture, easy to assemble, and easy to adapt to various existing engines for small crafts and vehicles.

BRIEF DESCRIPTION OF THE DRAWINGS

These and other objects, features and advantages of this invention will be apparent from the following detailed description, appended claims and accompanying drawings in which

DETAILED DESCRIPTION

Figure 1:
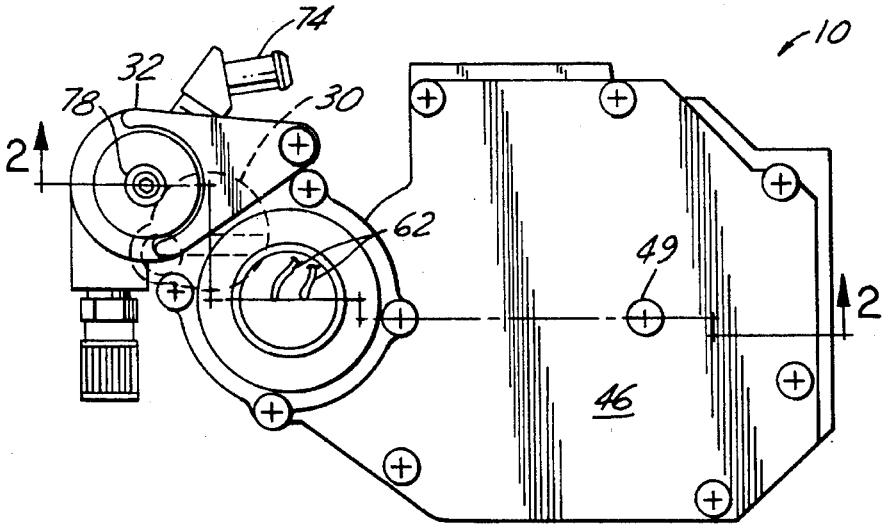
FIG. 1 is a plan view of the air/fuel handling device of the present invention for an outboard motor.
Figure 3:
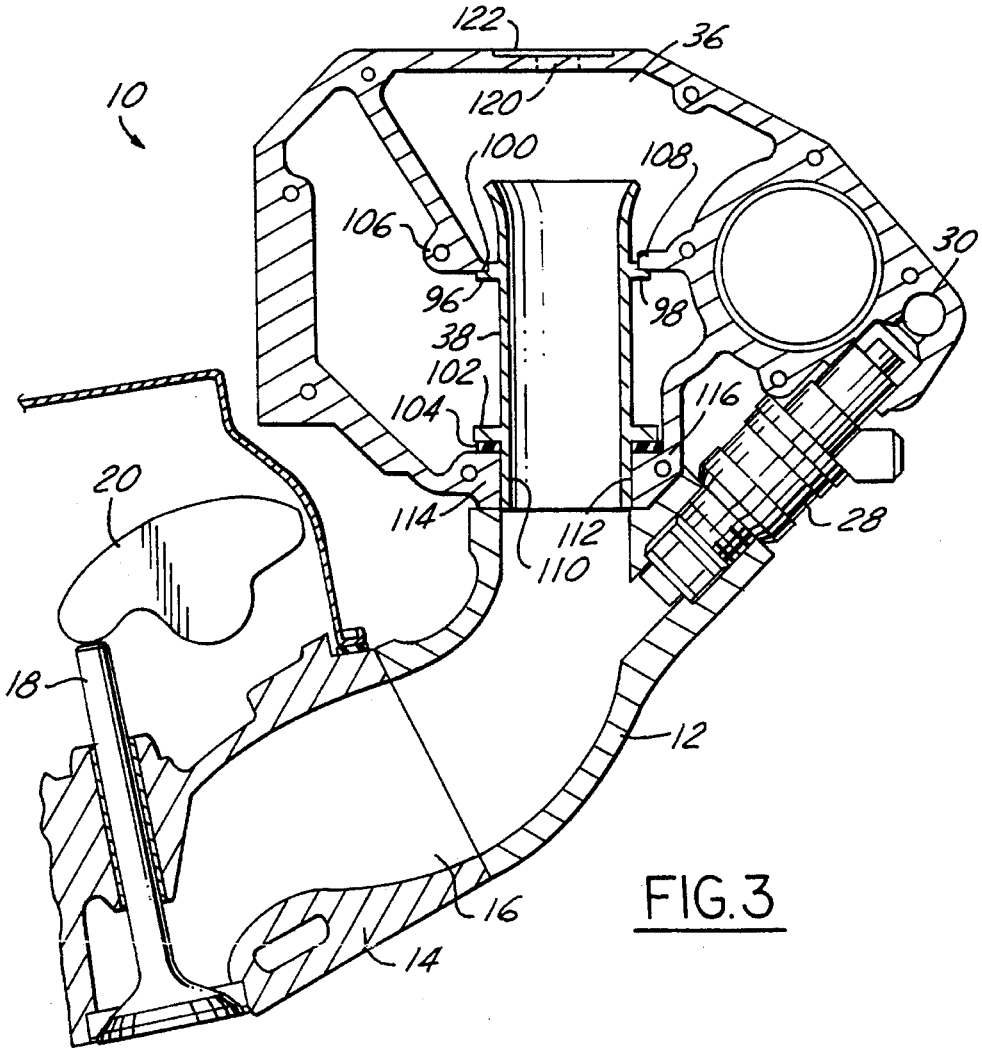
FIG. 3 is a sectional view taken along the line 3—3 FIG. 2 and showing the device mounted on an intake manifold of an outboard motor.

Referring in more detail to the drawings, FIGS. 1 and 3 illustrate an air/fuel handling device 10 embodying this invention mounted on the intake manifold 12 of an internal combustion engine such as an outboard motor with one or more cylinders and having a cylinder head 14 with an intake passage 16 and an intake valve 18 for each cylinder. The intake valve 18 is actuated by a cam shaft and drive train (not shown) through a rocker arm 20.

Liquid fuel from a gasoline tank is supplied through a metering assembly 22 and a fuel filter 24 to a fuel pump 26 which supplies fuel at a higher pressure (typically 30 to 60 p.s.i.) to one or more fuel injectors 28 through a fuel rail 30. The pressure of the fuel supplied to the injectors 28 is controlled by a fuel pressure regulator 26 which returns excess liquid fuel and fuel vapor to the metering assembly 22. Air to support combustion is supplied to the intake manifold 12 of the engine through throttle body 34, intake chamber 36 and ram tubes 38. In operation, fuel vapor is separated from the liquid fuel in the metering assembly 22 and discharged into air flowing through the throttle body.

Figure 2:
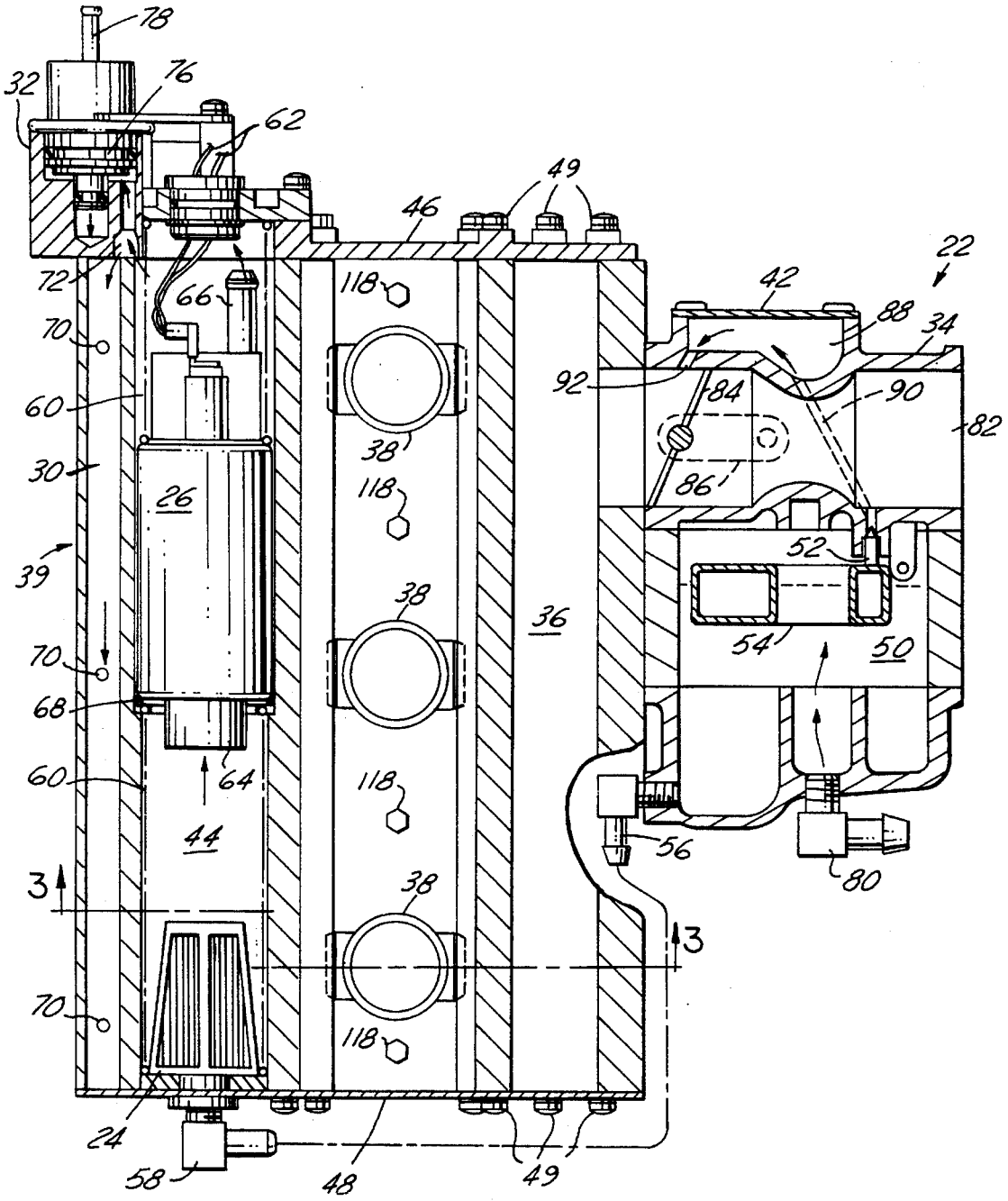
FIG. 2 is a sectional view taken along the line 2—2 of FIG. 1.

As shown in FIG. 2, the device 10 has a preferably extruded body 39 with an air tuning chamber 36, fuel pump chamber 44, and a fuel rail chamber 30 therein. The chambers 30,36,44 are separate, and preferably extend generally longitudinally and parallel to each other through the body. The ends of the chambers are closed off and sealed by end caps 46 and 48 secured by cap screws 50 to the extruded body. In use, the extruded chamber body is mounted on the engine intake manifold by cap screws 118.

Fuel from a remote gasoline tank is supplied to a metering chamber 50 in the metering assembly 22 through a needle valve 52 which is actuated to its open and closed position by a float 54 pivotally mounted in the chamber 50. The float 54 opens and closes the valve 52 to maintain the fuel within the chamber 50 at a fairly constant level or height therein and hence at a substantially constant pressure. Thus, as is known, when the fuel level falls below a certain point, the float 54 opens the metering valve 52 to allow fuel from the gasoline tank to enter the fuel metering chamber 50. The amount of fuel supplied to the fuel metering chamber 50 is just enough to raise the fuel level and thus the float 54 to the desired height to shut off the metering valve 52. The fuel metering chamber 50 has an outlet 56 to supply low pressure liquid fuel through an inlet 58 to the electric fuel pump 26 housed within the body. The fuel filter 24 is provided at the inlet 58 to filter the fuel supply to the fuel chamber 44. Preferably, the fuel pump 26 is mounted within the fuel chamber 44 by a pair of opposed springs 60. Electrical leads 62 extend from the fuel pump 26 to a power source (not shown). The fuel pump 26 has a low pressure inlet in communication with the fuel chamber 44 and a high pressure outlet 66 to supply high pressure fuel to the fuel rail 30. An O-ring 68 provides a seal between the inlet 64 and outlet 66 of the pump. The fuel rail 30 has one outlet 70 to each required injector 28 to supply high pressure fuel to each fuel injector 28 (FIG. 3) located between the outlet 70 and the intake manifold 12 of the engine.

The pressure regulator 76 is removably received in a pocket in a mounting block 32 attached to the chamber body. The pressure regulator has an inlet port which communicates through a passage 72 with the fuel rail passage 30 and high pressure outlet 66 of the pump and a discharge port which communicates through passages 73 with an outlet fitting 74. The regulator typically has a flow control valve actuated by a yieldably biased diaphragm with one side contacted and acted on by the high pressure liquid fuel and the other side communicating with either the atmosphere or engine intake manifold vacuum through an outlet port 78.

The outlet 66 of the fuel pump 26 simultaneously communicates with both the upper end of the fuel rail 30 and the intake port through the passage 72 of the pressure regulator 76. The pressure regulator 76 operates by bleeding excess fuel through the regulator 76 to the outlet fitting 74 to control and maintain the maximum pressure in both the fuel rail 30 and the outlet side of the fuel pump 26. To maintain constant maximum pressure, the fuel regulator 76 by-passes excess fuel back to the fuel metering chamber 50 through the outlet fitting 74 and a short line (not shown) connected to return port 80.

The pressure regulator 76 additionally returns air and fuel vapor to the fuel metering chamber 50. For example, at cold engine start-up, the fuel rail 30 may contain air. As liquid fuel at high pressure fills the fuel rail 30, the air is forced through the passage 72, regulator 76 and the outlet fitting 74 to the fuel metering chamber 50. If a hot engine is momentarily shut off and restarted, the temperature of the fuel rail 30 may be great enough to cause some of the liquid fuel to flash or vaporize. The resulting fuel vapor is then returned to the fuel metering chamber 50 via the outlet fitting through the regulator 76 as in the same manner previously described as in the fuel rail.

The throttle body 34 also has an air passage 82 to receive air from an intake (not shown). A throttle valve 84 therein controls the amount of air supplied to the engine. The throttle valve 84 is mounted on a shaft 85 controlled by an actuator arm 86 according to engine demand to control the amount of air supplied to the engine.

The vapor separator 42 preferably has a vapor dome 88 in the body 34 in communication with the fuel metering chamber 50 through a vapor port 90. A discharge port 92 communicates the vapor dome 88 with the air passage 82 downstream of the throttle 84 so that the fuel vapor is discharged into the air supplied to the engine. The fuel vapor and/or air in the fuel metering chamber 50, enters the vapor port 90, flows into the vapor dome 88 and out the exit port 92 to mix with air to be supplied to the engine. When the engine is operating, the sub-atmospheric pressure and partial vacuum created in the passage 92 downstream of the throttle valve 84 draws fuel vapor from the fuel metering chamber 50 into the passage 92 to mix with the air flowing therethrough.

The air chamber 36 in the body has an air inlet 94 to receive the air and any fuel vapor mixture, if present, from the air passage 82. The air chamber 36 has an air outlet for each engine intake manifold passage 16 in the form of a velocity stack or ram tube 38. Each tube 38 is releasably mounted in the chamber by a pair of opposed and radially projecting tabs 96,98 each having a stepped portion 100 adjacent one end and an annular flange 102 adjacent the other end. A spring or wave washer 104 is installed on the tube 38 at the end with the annular flange 102. In assembly, the tabs 96 & 98 of the tube 38 bear on adjacent edges of internal walls 106 and 108 of the chamber which define a slot between them with the other end 110 of the tube slidably received in a bore 112 through the exterior wall 114 of the chamber. Different tube lengths and diameters can be used depending on the specific engine tuning requirements.

Each tube 38 is installed through an open end of the body before both end caps 46,48 are installed. Each tube is disposed in the chamber with its tabs 96 & 98 rotated 90° from the position shown in FIG. 2 to pass between and avoid interference with walls 106 & 108 of the body. The tube end 110 with the spring washer 104 thereon is then inserted axially into the bore 112 to compress the Washer. The tube 38 is then rotated 90° and released with the tabs 96,98 in the position shown in FIG. 2 bearing on the walls 106 & 108. The spring washer 104 expands against the annular flange 102 forcing the stepped portion 100 of each tab 96,98 into firm retaining engagement with the walls 106,108. Once all the tubes 38 are installed, the remaining end caps 46,48 are fastened to the body by cap screws 49.

For use, the device 10 is mounted on the intake manifold 12 by the engine by cap screws 118. Access to the cap screws 118 is provided by access holes 120 drilled through a rectangular slotted portion 122. For example, a driving head and extension of a power tool may be inserted through the holes 120 for driving the cap screws 118. When the device 10 has been mounted, a decal, snap plugs, or other cover may be placed over the rectangular slotted portion 122 to cover and seal the holes 120 and create a more pleasing appearance.

In operation, liquid fuel is supplied to the system from a remote gas tank (not shown) to fuel metering chamber 50 through inlet valve 52. The fuel pump 26 draws fuel at low pressure from the fuel metering chamber 50 through the filter 24 into the low pressure side of the fuel chamber 44 through outlet 56, inlet 58 and an interconnecting tube. The fuel pump 26 supplies high pressure fuel through outlet 66 to the fuel rail 30 through passage 72. The high pressure fuel then flows through each outlet 70 to the fuel injectors 28, which periodically discharge fuel into the intake manifold 12 to mix with air therein. The pressure regulator limits the maximum fuel pressure by by-passing or bleeding off a portion of the fuel which is returned to the metering chamber.

Air is supplied to the system though the passage 82. On engine demand, throttle valve 84 opens to allow air to flow into chamber 36 through inlet 94. Air then flows through the ram tubes 38 to intake manifold 12 to mix with the liquid fuel supplied by the fuel injectors 28. Thereafter, the air-fuel mixture flows to the cylinder head 14 and to the engine cylinder (not shown) through intake valve 18. Air chamber 36 provides sound attenuation to guiet the typical air intake noises. Preferably, additional air silencers (not shown) are also used.

Engine operating noise is significantly attenuated by disposing the ram tubes 38 within the air chamber, providing a non-linear or sinuous air flow path from the intake to the engine manifold, and a relatively large volume air chamber surrounding the ram tubes.

This system can be readily tuned to maximize the desired performance characteristics of an engine for a given application by simply changing the diameter, length and length to diameter ratio of the ram tubes. Usually this performance tuning can be accomplished by changing only the ram tubes without changing the other components of the system. This provides a relatively quick, easy and inexpensive way to adapt and apply this system to a wide variety of engines and engine performance characteristics. The desired length, diameter and ratio of the tubes for a given engine and desired performance characteristics can be readily determined by a skilled engine and fuel/air system designer and hence how to do so will not be described herein.

Thus, it can be seen that an air/fuel handling system for a fuel injection engine is provided for small engine crafts having low pressure fuel supplied from a remote gasoline tank. The fuel pump then supplies high pressure fuel to the engine via the fuel rail. Additionally, a fuel return line is provided from the pressure regulator to the fuel metering chamber to return fuel vapor and fuel overflow to the fuel metering chamber.

The system can be economically manufactured and assembly by utilizing a relatively simple extrusion preferably of aluminum for the chamber body with an inexpensive end plate and the fuel metering and throttle valve body may be a body for a conventional float bowl carburetor.

What is claimed is:

1. An air/fuel handling system for a fuel injection engine comprising:

a body having a fuel chamber, a fuel rail passage having at least one outlet to supply fuel to at least one fuel injector, and an air chamber having an inlet and at least one outlet to supply air to the engine, a fuel pump disposed in said fuel chamber and having a low pressure inlet and a high pressure outlet in fluid communication with the fuel rail passage, a housing connected to said body, a low pressure fuel metering chamber in said housing in communication with said low pressure inlet of said fuel pump, and having a metering valve to control fuel flow from a remote supply to said metering chamber, an air flow passage in said housing communicating with the inlet of said air chamber and having a throttle valve therein to control air flow to said air chamber, and a vapor separator carried by said housing in communication with said fuel metering chamber and the inlet of said air chamber to allow fuel vapor to flow into said air chamber.

2. The air/fuel handling system of claim 1 wherein said vapor separator comprises:

a vapor dome in said housing, a vapor port communicating said vapor dome with said fuel metering chamber, and a discharge port communicating said vapor dome with said air flow passage downstream of the throttle valve.

3. The air/fuel handling system of claim 1 wherein said fuel pump is received within said fuel chamber, said fuel chamber having an inlet to receive fuel from said fuel metering chamber to supply fuel to said low pressure inlet of said fuel pump and an outlet to supply fuel from said high pressure outlet of said pump to said fuel rail.

4. The air/fuel handling system of claim 3 comprising:

a pressure regulator carried by said body to regulate high pressure fuel flow from said fuel chamber to said fuel rail.

5. The air/fuel handling system of claim 4 comprising:

an overflow outlet in said pressure regulator in communication with said fuel metering chamber to discharge excess fuel from said fuel rail to said metering chamber.

6. The air/fuel handling system of claim 3 wherein said body is extruded, and said fuel rail, said fuel chamber and said air chamber are elongate and extend axially within said body.

7. The air/fuel handling system of claim 6 comprising end caps carried by said body to enclose said fuel rail, said fuel chamber and said air chamber, wherein said fuel rail, said fuel chamber and said air chamber extend longitudinally and generally parallel to each other within said body.

8. The air/fuel handling system of claim 1 comprising ram tubes located within said air chamber to provide air from said air chamber to the engine, said ram tubes having a predetermined diameter turned to the engine.

9. The air/fuel handling system of claim 1 wherein said air chamber provides noise attenuation of air flowing from said air flow passage into said ram tubes.

10. A fuel handling system for a fuel injection engine comprising:

a body, a fuel rail in said body and having at least one outlet to supply fuel to a fuel injector located at said outlet, a fuel pump located within said body and having a low pressure inlet to receive fuel from a fuel supply and a high pressure outlet to supply fuel to said fuel rail, a pressure regulator carried by said body to regulate high pressure fuel flow from said fuel pump to said fuel rail, and an overflow outlet in said pressure regulator in communication with the fuel supply to discharge excess fuel from said fuel rail.

11. The fuel handling system of claim 10 wherein said body has a fuel chamber therein, said fuel pump is received in said fuel chamber, said fuel chamber having an inlet to receive low pressure fuel from the fuel supply to supply fuel to said low pressure inlet of said fuel pump and an outlet to supply fuel from said high pressure outlet of said fuel pump to said fuel rail.

12. The fuel handling system of claim 11 wherein said body is extruded, and said fuel rail and said fuel chamber are elongate and extend axially within said body.

13. The fuel handling system of claim 12 comprising end caps to enclose said fuel rail and said fuel chamber, wherein said fuel rail and said fuel chamber extend longitudinally generally parallel to each other within said body.

14. An air/fuel handling system for a fuel injection engine comprising a body, a fuel chamber in said body and having a low pressure fuel inlet, a fuel pump received in said fuel chamber and having a pump inlet communicating with said low pressure fuel inlet and a high pressure pump outlet to supply fuel to at least one fuel injector of the engine, an air chamber in said body having an inlet and at least one outlet to supply air to the engine, an air/fuel housing connected to said body, an air flow passage in said housing communicating with the inlet of said air chamber and having a throttle valve therein to control air flow to said air chamber, a low pressure fuel .metering chamber formed in said housing and having a metering valve to control fuel flow from a fuel supply to the fuel metering chamber, and a vapor separator carried by said housing in communication with said fuel metering chamber and the inlet of said air chamber to allow fuel vapor to flow into said air chamber.

15. An air/fuel handling system for a fuel injection engine comprising a body, an air chamber in said body having an inlet and at least one outlet to supply .air to the engine, an air/fuel housing connected to said body, an air flow passage in said housing communicating with the inlet of said air chamber and having a throttle valve therein to control air flow to said air chamber, a low pressure fuel metering chamber formed in said housing and having a metering valve to control fuel flow from a fuel supply to the fuel metering chamber, and a vapor separator carried by said housing in communication with said fuel metering chamber and the inlet of said air chamber to allow fuel vapor to flow into said air chamber, said vapor separator having a vapor dome formed in said housing, a vapor port communicating said vapor dome with said fuel metering chamber, and a discharge port communicating said vapor dome with said air flow passage downstream of the throttle.

16. The fuel handling system of claim 12 wherein said body is extruded, and said air chamber extends axially within said body.

17. The air/fuel handling system of claim 14 comprising ram tubes located within said air chamber to provide air from said air chamber to the engine, said ram tubes having a predetermined diameter turned to the engine.

18. The air/fuel handling system of claim 14 wherein said air chamber provides noise attenuation of air flowing from said air flow passage into said ram tubes.

19. A fuel handling system for an engine with at least two fuel injectors comprising:

a body, a fuel rail carried by said body and having at least two spaced apart outlets each to supply fuel directly to a separate fuel injector connected to each said outlet, a fuel pump located within said body and having a low pressure inlet to receive fuel from a fuel supply and a high pressure outlet to supply fuel to said fuel rail and the fuel injectors connected thereto, and a pressure regulator carried by said body to regulate high pressure fuel flow from said fuel pump to said fuel rail and the injectors connected thereto.

20. An air/fuel handling system for an engine with a fuel injector, comprising:

an extruded body having a fuel chamber extending generally axially in said body, an air chamber extending generally axially in said body and having an inlet and at least one outlet to supply air to the engine, said fuel chamber extending generally parallel to said air chamber, and a fuel pump disposed in said fuel chamber and having a low pressure fuel inlet and a high pressure fuel outlet in communication with the fuel injectors of the engine.

21. The air/fuel handling system of claim 20 wherein said extruded body has generally opposed ends, said fuel chamber and said air chamber open into said opposed ends of said body and the system also comprises end caps carried by said body on its opposed ends to enclose said fuel chamber and said air chamber.

22. The air/fuel handling system of claim 20 comprising ram tubes located within said air chamber to provide air from said air chamber to the engine, said ram tubes having a predetermined diameter turned to the engine.

23. The air/fuel handling system of claim 22 wherein said air chamber provides noise attenuation of air flowing from said air flow passage into said ram tubes.

* * * * *